US010827796B2

(12) United States Patent
Green

(10) Patent No.: US 10,827,796 B2
(45) **Date of Patent: *Nov. 10, 2020**

(54) TRANSITIONAL SHOE WITH SCREW-ON HEEL

(71) Applicant: Gabrielle Green, New York, NY (US)

(72) Inventor: Gabrielle Green, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,249

(22) Filed: Sep. 28, 2017

(65) Prior Publication Data

US 2018/0014600 A1 Jan. 18, 2018

Related U.S. Application Data

(63) Continuation of application No. 14/983,271, filed on Dec. 29, 2015, now Pat. No. 9,775,399, which is a (Continued)

(51) Int. Cl.

| | |
|---|---|
| ***A43B 7/14*** | (2006.01) |
| ***A43B 13/34*** | (2006.01) |
| ***A43B 21/37*** | (2006.01) |
| ***A43B 21/39*** | (2006.01) |
| ***A43B 23/02*** | (2006.01) |
| ***A43B 23/22*** | (2006.01) |
| ***A43B 3/24*** | (2006.01) |
| ***A43B 21/42*** | (2006.01) |

(Continued)

(52) U.S. Cl.

CPC ..... *A43B 3/24* (2013.01); *A43B 1/0018* (2013.01); *A43B 7/142* (2013.01); *A43B 13/04* (2013.01); *A43B 13/10* (2013.01); *A43B 13/141* (2013.01); *A43B 13/30* (2013.01); *A43B 13/34* (2013.01); *A43B 13/36* (2013.01); *A43B 13/41* (2013.01); *A43B 21/37* (2013.01); *A43B 21/38* (2013.01); *A43B 21/39* (2013.01); *A43B 21/42* (2013.01); *A43B 23/02* (2013.01); *A43B 23/047* (2013.01); *A43B 23/22* (2013.01)

(58) Field of Classification Search

CPC ..... A43C 15/161; A43B 21/39; A43B 21/42; A43B 21/37; A43B 13/24; A43B 7/142; A43B 23/22; A43B 23/02

USPC .... 36/34 A, 36 B, 36 C, 36 R, 41, 45, 67 D, 36/76 R, 100, 107, 108, 124, 145, 8.3, 11, 36/88, 97

See application file for complete search history.

(56) References Cited

U.S. PATENT DOCUMENTS

| | | | |
|---|---|---|---|
| 980,987 | A | 1/1911 | Mitlehner |
| 1,375,671 | A | 4/1921 | Lester et al. |

(Continued)

FOREIGN PATENT DOCUMENTS

| | | | |
|---|---|---|---|
| CN | 2209885 | Y | 10/1995 |
| CN | 2501344 | Y | 7/2002 |

(Continued)

OTHER PUBLICATIONS

European Search Report dated Jul. 3, 2013 issued in related EP Application No. 10819385.5 (8 pages).

(Continued)

*Primary Examiner* — Clinton T Ostrup
*Assistant Examiner* — Cameron A Carter
(74) *Attorney, Agent, or Firm* — Dentons US LLP

(57) ABSTRACT

Provided is a shoe with a replaceable screw-on heel.

17 Claims, 3 Drawing Sheets

Related U.S. Application Data continuation of application No. 12/886,360, filed on Sep. 20, 2010, now Pat. No. 9,220,317.

(60) Provisional application No. 61/245,531, filed on Sep. 24, 2009.

(51) Int. Cl.

| | |
|---|---|
| ***A43B 13/14*** | (2006.01) |
| ***A43B 13/36*** | (2006.01) |
| ***A43B 1/00*** | (2006.01) |
| ***A43B 13/04*** | (2006.01) |
| ***A43B 13/10*** | (2006.01) |
| ***A43B 13/30*** | (2006.01) |
| ***A43B 13/41*** | (2006.01) |
| ***A43B 23/04*** | (2006.01) |
| ***A43B 21/38*** | (2006.01) |

(56) References Cited

U.S. PATENT DOCUMENTS 1,516,355 A * 11/1924 Swetzoff ..... A43B 13/34 36/42
1,743,543 A * 1/1930 Gutierrez ..... A43B 21/48 36/42
1,996,659 A * 4/1935 Staines ..... A43B 13/34 36/42
2,050,644 A * 8/1936 Book ..... A43B 13/34 36/34 R
2,139,885 A * 12/1938 De Gironimo ..... A43B 21/36 36/152
2,223,339 A * 12/1940 De Liso ..... A43C 11/006 36/45
2,224,476 A * 12/1940 Farina ..... A43B 21/38 36/42
2,228,065 A * 1/1941 Sbicca ..... A43C 11/006 36/51
2,374,954 A * 5/1945 Pipitone ..... A43B 13/34 36/34 R
2,449,914 A * 9/1948 Simonetti ..... A43B 21/45 36/42
2,701,925 A * 2/1955 Luhr ..... A43B 5/12 36/113
2,707,341 A * 5/1955 Romano ..... A43B 13/34 36/100
2,767,489 A * 10/1956 Sturman ..... A43B 21/437 36/34 R
2,829,447 A * 4/1958 Odom ..... A43B 21/433 36/42
2,873,540 A * 2/1959 Murphy ..... A43B 3/24 36/101
2,934,840 A * 5/1960 Mistarz ..... A43B 13/34 36/34 R
3,078,599 A 2/1963 Mileto et al.
3,144,722 A * 8/1964 Cortina ..... A43B 21/37 36/36 R
3,193,949 A 7/1965 Cortina et al.
3,373,510 A 3/1968 Memole et al.
3,514,879 A * 6/1970 Frattallone ..... A43B 21/46 36/42
3,564,232 A 2/1971 Ellerbe et al.
3,646,497 A * 2/1972 Gillikin ..... A43B 13/34 36/42
3,750,208 A * 8/1973 Wyatt ..... A43D 3/1433 12/115.8
3,782,010 A * 1/1974 Frattallone ..... A43B 21/36 36/42
3,794,037 A * 2/1974 Matteson ..... A43B 7/1465 36/156
3,946,505 A * 3/1976 Dana, III ..... A43B 1/0036 36/137
3,977,095 A * 8/1976 Phillips ..... A43B 1/0054 36/42
4,062,132 A 12/1977 Klimaszewski
4,219,946 A * 9/1980 Baum ..... A43B 3/24 36/24.5
4,245,407 A 1/1981 Mazabras
4,272,897 A * 6/1981 Ponce ..... A43B 23/22 36/24.5
4,349,970 A * 9/1982 Silver ..... A43B 13/28 36/12
4,363,177 A * 12/1982 Boros ..... A43B 21/39 36/101
4,400,893 A * 8/1983 Musci ..... A43B 13/34 12/142 J
4,443,956 A * 4/1984 Caccavale ..... A43D 999/00 36/36 R
4,610,100 A * 9/1986 Rhodes ..... A43B 21/39 36/36 A
4,667,421 A * 5/1987 Rouhani ..... A43B 21/51 36/36 C
4,805,320 A * 2/1989 Goldenberg ..... A43B 1/0054 36/36 R
4,967,542 A * 11/1990 MacDonald ..... A01K 13/007 36/111
5,025,574 A * 6/1991 Lasher, III ..... A43B 21/40 36/36 R
5,079,857 A * 1/1992 Clifton ..... A43B 21/36 36/36 R
5,133,138 A * 7/1992 Durcho ..... A43B 1/0054 36/100
5,309,651 A * 5/1994 Handel ..... A43B 21/433 36/100
5,347,730 A * 9/1994 Rodriguez Colon .... A43B 3/24 36/100
5,373,649 A * 12/1994 Choi ..... A43B 21/37 36/36 R
5,410,820 A * 5/1995 Goodman ..... A43B 3/24 36/100
5,456,026 A * 10/1995 Lewis ..... A43B 1/0054 36/36 R
5,477,625 A * 12/1995 Goldsmith ..... A43B 1/0054 36/100
5,524,365 A * 6/1996 Goldenberg ..... A43B 3/24 36/36 C
5,542,198 A * 8/1996 Famolare ..... A43B 5/00 36/114
5,581,910 A * 12/1996 Lewis ..... A43B 1/0054 36/36 R
D378,548 S * 3/1997 Harman, II ..... D2/925
5,675,916 A 10/1997 Lewis
5,887,360 A * 3/1999 Bucalo ..... A43B 3/24 36/100
5,953,836 A * 9/1999 Watt ..... A43B 3/24 36/100
6,023,858 A * 2/2000 Srourian ..... A43B 3/24 36/11.5
6,631,570 B1 * 10/2003 Walker ..... A43B 3/24 36/100
6,711,835 B1 * 3/2004 Militello ..... A43B 21/42 36/36 B
7,185,448 B2 * 3/2007 Schupbach ..... A43B 3/24 36/100
7,578,075 B1 * 8/2009 Kemp ..... A43B 3/24 36/100
8,132,341 B1 * 3/2012 Laramore ..... A43B 21/50 36/100
8,657,110 B2 * 2/2014 Angiulo ..... A43B 3/246 206/278
9,220,317 B2 12/2015 Green
2002/0144436 A1 * 10/2002 Magallanes ..... A43B 21/42 36/100
2003/0033729 A1 * 2/2003 Farrior ..... A43B 3/00 36/8.3
2003/0070319 A1 * 4/2003 Minden ..... A43B 3/108 36/8.3

(56) References Cited

U.S. PATENT DOCUMENTS

| | | | | |
|---|---|---|---|---|
| 2005/0022420 | A1* | 2/2005 | Thomas | A43B 1/009 36/8.1 |
| 2006/0162184 | A1* | 7/2006 | Nelson, Jr. | A43B 5/005 36/8.3 |
| 2006/0196082 | A1* | 9/2006 | Robbins | A43B 3/24 36/42 |
| 2007/0000152 | A1* | 1/2007 | Nakayama | A43B 21/42 36/42 |
| 2007/0011909 | A1* | 1/2007 | Palmeri, III | A43B 3/24 36/42 |
| 2008/0034620 | A1* | 2/2008 | Gallegos | A43B 13/37 36/36 R |
| 2008/0086906 | A1* | 4/2008 | Wilkenfeld | A43B 5/12 36/8.3 |
| 2008/0235991 | A1* | 10/2008 | Visser | A43B 3/24 36/100 |
| 2009/0133291 | A1* | 5/2009 | Frasconi | A43B 21/24 36/108 |
| 2016/0198795 | A1* | 7/2016 | Lopez-Velasquez | A43B 21/42 36/100 |

FOREIGN PATENT DOCUMENTS

| | | |
|---|---|---|
| CN | 2792244 Y | 7/2006 |
| DE | 102004017113 | 10/2005 |
| EP | 248941 | 12/1987 |
| NL | 9101991 | 6/1993 |
| TW | 240384 | 8/1983 |
| WO | WO 1992/20248 | 11/1992 |
| WO | WO 2001/78543 | 10/2001 |
| WO | WO 2004/037029 | 5/2004 |
| WO | WO 2005/000062 | 1/2005 |
| WO | WO 2006/113574 | 10/2006 |
| WO | WO 2007/056791 | 5/2007 |
| WO | WO 2008125705 | 10/2008 |

OTHER PUBLICATIONS

International Search Report dated Nov. 8, 2010 issued in related PCT Application No. PCT/US10/49806 (5 pages).
CN 2209885Y Published Oct. 18, 1995, abstract only in English (1 page).
CN 2501344Y Published Jul. 24, 2002, abstract only in English (1 page).
CN 2792244Y Published Jul. 5, 2006, abstract only in English (1 page).
DE 102004017113 Published Oct. 27, 2005, abstract only in English (1 page).
EP0248941, Kallay, Issued Dec. 16, 1987, Abstract Only in English, downloaded from ESP@cenet (1 page).
NL 9101991 Published Jun. 16, 1993, abstract only in English (1 page).
WO 2008/125705, Lorenzo Gomez, Published Oct. 23, 2008, Abstract Only in English, downloaded from Esp@cenet (1 page).

* cited by examiner

TRANSITIONAL SHOE WITH SCREW-ON HEEL

CROSS-REFERENCE TO RELATED APPLICATIONS

This application is a Continuation of U.S. application Ser. No. 14/983,271 filed 29 Dec. 2015; which is a Continuation of U.S. application Ser. No. 12/886,360 filed 20 Sep. 2010, now U.S. Pat. No. 9,220,317 issued 29 Dec. 2015; which claims a benefit of priority to U.S. Application 61/245,531 filed 24 Sep. 2009; each of which is incorporated herein by reference in its entirety for all purposes.

BACKGROUND

The present invention generally relates to footwear. More specifically, a shoe with a screw-on heel is provided.

There have been several shoes described that provide replaceable heels. See, e.g., U.S. Pat. Nos. 980,987; 1,516,355; 1,743,543; 2,707,341; 3,078,599; 3,193,949; 3,782,010; 4,219,946; 4,349,970; 4,443,956; 5,025,574; 5,079,857; 5,581,910; 5,953,836; 6,631,570; U.S. Patent Application Publication No. 2008/0235991 A1; U.S. Design Pat. No. D378,548; and PCT Publication No. WO 2005/000062 A1.

While some of these shoes provide a screw to attach the replaceable heel to the upper, those designs are generally complicated to use, and often require additional components such as a screwdriver to attach the replaceable heel. The transitional shoe with screw-on heel described herein provides a simpler replaceable heel that does not require an additional tool to remove or attach.

SUMMARY

Described herein is a shoe that can be transitioned between heels of different heights or styles. The transition is accomplished by unscrewing the heel to be replaced from the upper and replacing it with another heel by screwing the replacement heel into the upper. Thus, a shoe comprising an upper and a detachable heel is provided herewith. The heel screws into the upper, or unscrews from the upper, using a single screw imbedded into the heel.

Also provided is a heel for a shoe upper. The heel comprises a top portion designed to attach to the upper, and a bottom portion designed to contact the ground when the upper is attached to the heel. The heel comprises a single screw extending outward from the top of the shoe perpendicular to the ground.

Additionally, another heel for a shoe upper is provided. The heel comprises a top portion designed to attach to the upper, and a bottom portion designed to contact the ground when the shoe is attached to the heel. In these embodiments, the heel comprises a threaded barrel to which a screw protruding from the upper can be inserted in order to secure the heel to the upper.

DETAILED DESCRIPTION

Figure 1:
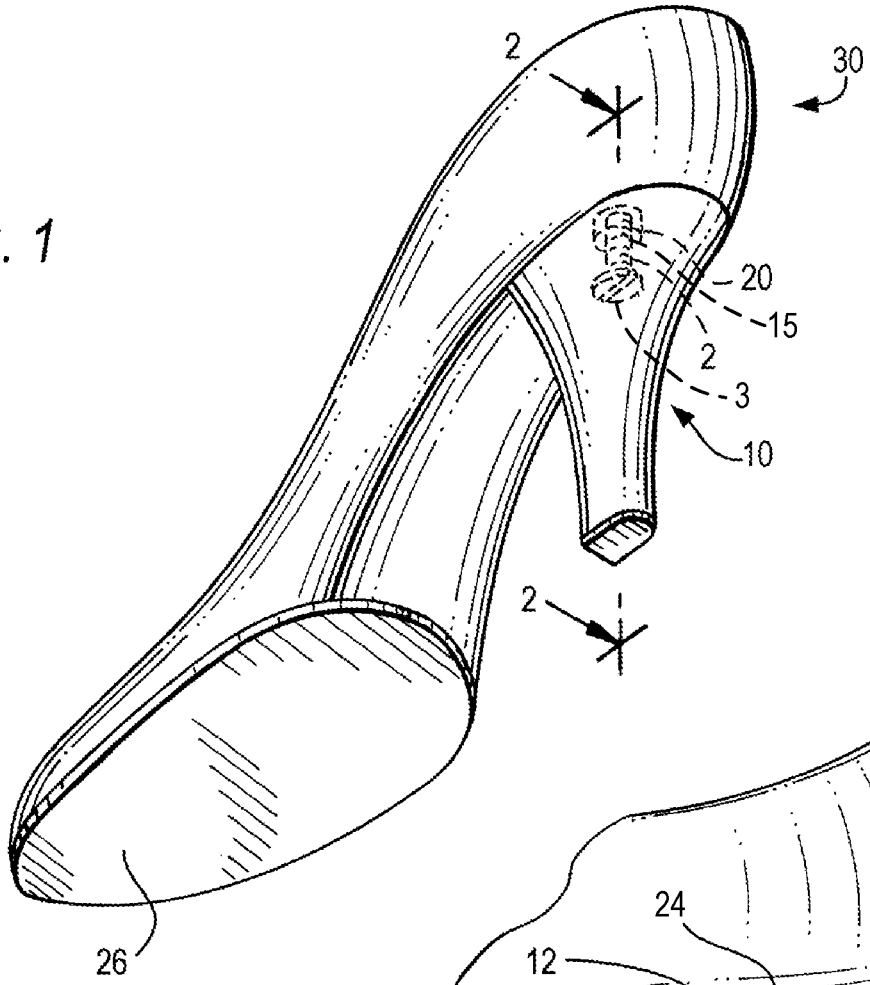
FIG. 1 is a bottom ¾ perspective view of an illustrative embodiment of the heel coupled to the shoe.
Figure 2:
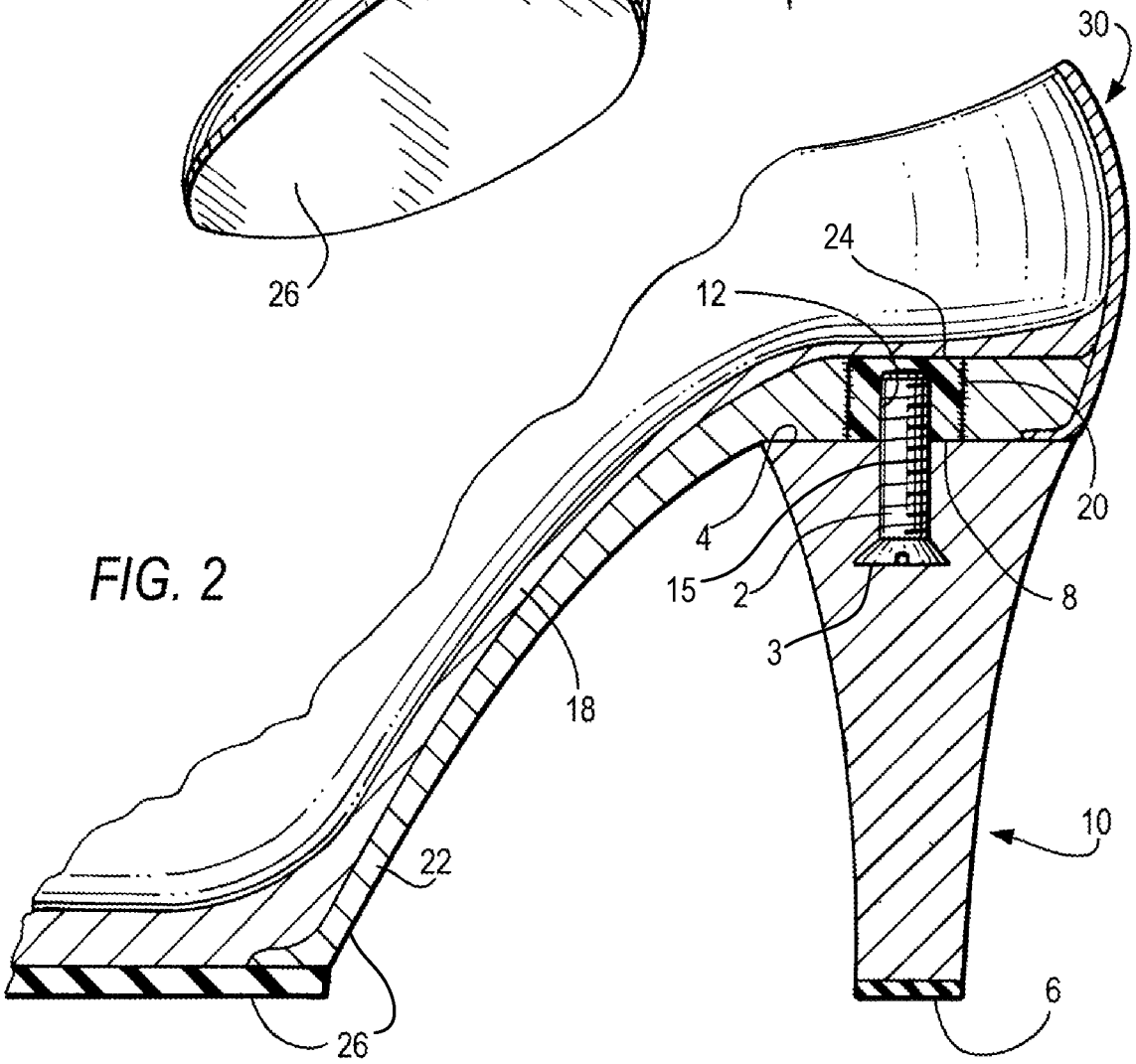
FIG. 2 is a partial cross-section of the shoe with heel attached of FIG. 1 at cross-section 2-2, showing the screw and barrel in place, according to an illustrative embodiment.

As used herein, the singular forms "a", "an" and "the" are intended to include the plural forms as well, unless the context clearly indicates otherwise. Additionally, the use of "or" is intended to include "and/or" unless the context clearly indicates otherwise.

Provided herewith is a shoe comprising an upper and a detachable heel, wherein the heel attaches to the upper using a single screw. This shoe allows for the expedient and convenient replacement, change, and removal of high heels into flat form and vice versa through simple screw-on action. This rapid heel replacement can be used in consideration of, e.g., fashion, preference, comfort when walking, changes of venue, and the provision of heels of different shapes and sizes.

FIGS. 1-5 illustrate exemplary embodiments. In some of these embodiments, the screw 2 protrudes from the heel 10 and the upper 30 comprises a threaded barrel 20 to which the screw 2 can be inserted in order to secure the heel 10 to the upper 30.

Also provided is a heel 10 for a shoe upper 30. The heel 10 comprises a top portion 4 designed to attach to the upper 30, and a bottom portion 6 designed to contact the ground when the upper 30 is worn with the heel 10. The heel comprises a single screw 2 extending outward from the top 4 of the heel 10 perpendicular to the ground. Aside from the screw, the heel 10 need not comprise any additional components at the top 4 of the heel 10 to assist in attaching the heel 10 to the upper 30.

The heels of any of the shoes described herein can be of any type or height known in the art that would accommodate a screw of sufficient strength to stably secure the heel to the upper. The heel can be, e.g., a high heel, a flat heel, or a heel of mid height. As used herein, a high heel is two inches or higher from top to bottom; a flat heel is an inch or less, and a mid-size heel is between 1 and 2 inches. Examples of heels that can be used for these embodiments are pyramid heels, stilettos, spike heels, kitten heels, and block heels.

These embodiments are also not narrowly limited to any particular type of upper that accommodates the heel. Non-limiting examples of uppers include boots, slingbacks, mules, pumps, and slippers. The shoes can be designed for women or men.

The barrel 20 in the upper 30 and the screw 2 in the heel 10 together effectively form a sex bolt, as that term is used in the art, i.e., a threaded screw and a corresponding barrel that receives the screw. Indeed, commercially available sex bolts can be used in the construction of any of the shoes and heels described herein.

The heel 10 is attached by inserting the screw 2 of the heel 10 into the aperture 8 of the barrel 20 and rotating the heel 10 in the direction (clockwise or counterclockwise, depending on the screw 2 and barrel 20 used) that causes the top portion 4 of the heel 10 to move toward the upper 30, until the heel 10 and upper 30 are securely joined. To detach the heels, e.g., to change heels, the heel 10 is rotated in the direction that causes the upper 30 to separate from the heel 10.

In some embodiments, the upper further comprises a heel of a flat, so that the upper can be worn as a flat without attaching a heel that has a screw. In these embodiments, the barrel 20 is embedded in the flat heel.

The barrel 20 can be affixed to the upper 30 by any known means, e.g., sewing it into a pocket in the upper, for example through a hole in the outersole 26 and abutting the midsole 18. In those embodiments, the midsole can optionally be reinforced, e.g., with a metal, plastic or leather disk, to help support the barrel 20.

The heel 10 can be made without having to include extraneous pieces. Construction is therefore economical. The heel 10 can be made of any materials normally used for heel production, including but are not limited to metal and wrapped plastic resin. When plastic resin is used, the heel 10 can be cast with the screw in place. The head 3 of the screw 2 faces the bottom 6 of the heel 10 so the threaded shaft 15 and the end that enters the barrel 20 is upwards, pointing towards the receiving barrel 20 located in the shoe upper 30. The barrel 20 has an upper solid portion 24 to prevent the screw from extending into or beyond the midsole 18. When the heel 10 is made of metal, the heel can be made to mirror the design of the screw 2, with thread 12 having the same rotational handedness (clockwise or counterclockwise), ensuring secure fastening of the thread 12 within the barrel 20 located in the shoe upper 30. In this embodiment or other embodiments, the screw can be formed from the heel material.

When the shoe is converted from a flat to a high heel by replacing or adding the replaceable heel, the shoe bends at the ball of the foot. This tends to cause the shoe to deform from the flat form. In order to help the shoe keep its form, some embodiments of the shoes described herein further comprise a shank 22 and/or an uppermost edge 14' comprising supporting stitching.

Thus, in some embodiments, the upper 30 comprises an arch (i.e., a bow or curve designed to fit the curve of the bottom of a foot), an insole (not shown), a midsole 18, an outersole 26 and a shank 22. The shank in these embodiments is a flat, rigid plate that mirrors the arch of the upper 30. Beside providing shape retention for the upper 30, the shank also allows the flat form of the shoe to provide the same arch support as the shoe in high-heeled form. The shank can be inserted in any location in the sole, and can be any length required to provide adequate support. In some embodiments, the shank is extended to be present above the heel of the upper to provide support for the barrel. In various embodiments, the shank 22 resides between the midsole 18 and the outersole 26. The shank can be made of any rigid material, for example a rigid plastic or a metal. In certain embodiments, particularly when the shank lies above the heel, the shank and the barrel are one continuous piece of metal.

Figure 4:
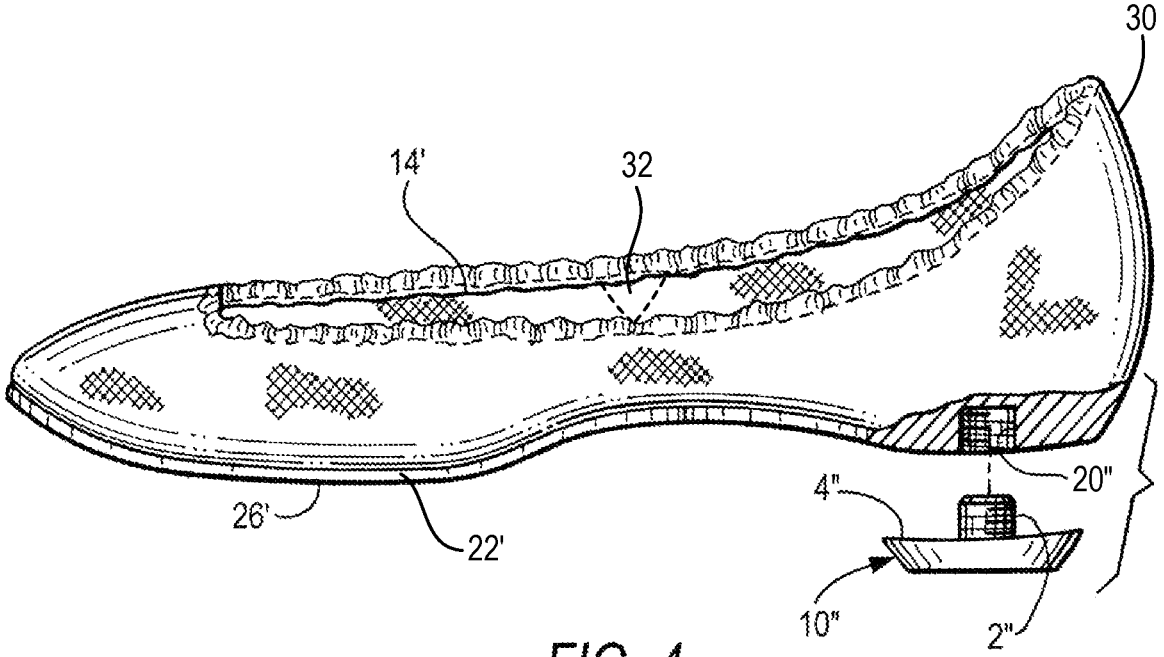
FIG. 4 is a cross-section of a heel and barrel shown with a full view of the upper, according to an illustrative embodiment.
Figure 5:
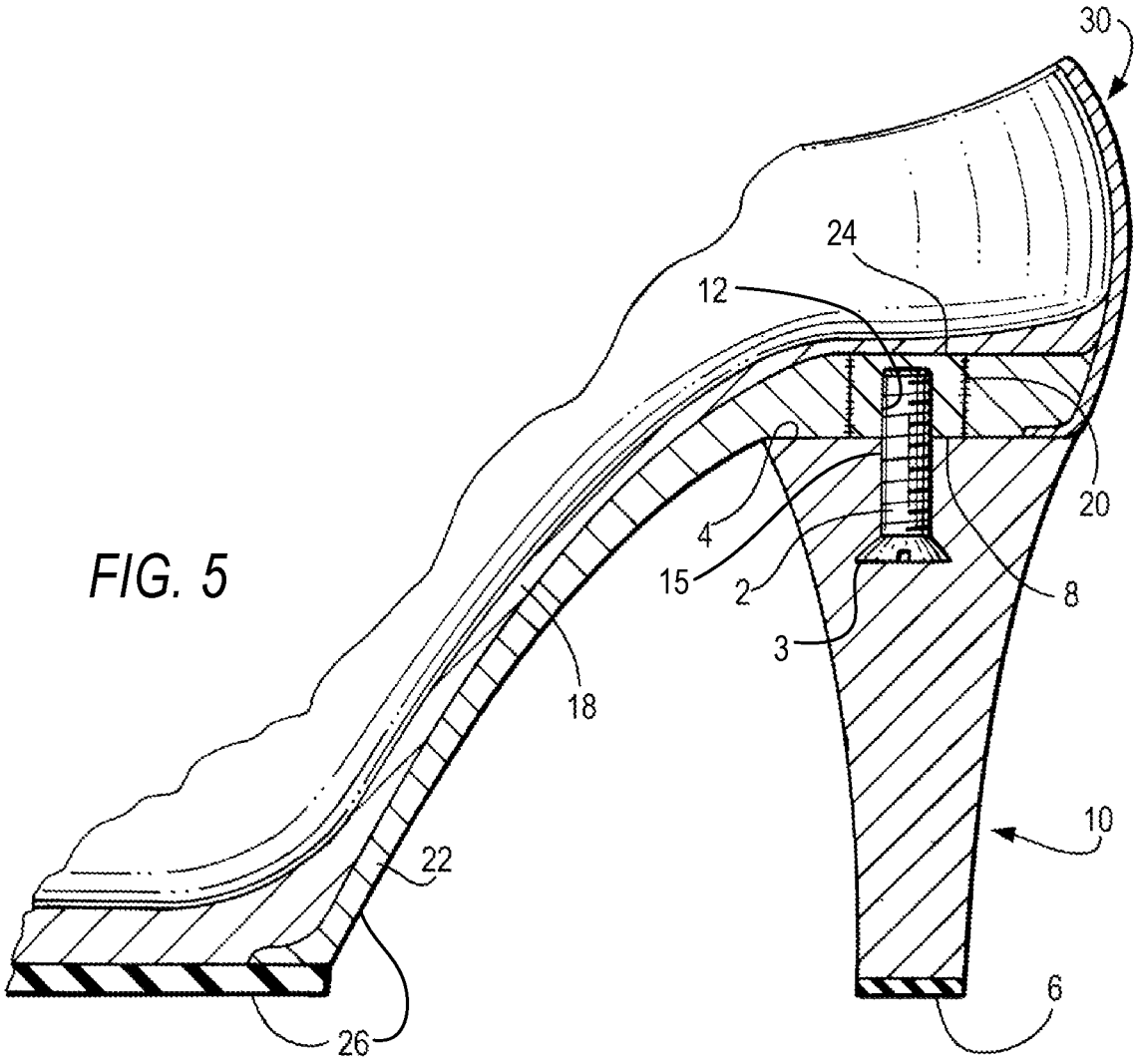
FIG. 5 is a partial cross-section of the shoe with heel attached of FIG. 1 at cross-section 2-2, showing the screw and barrel in place, and showing a shank and the barrel comprising a same material according to an illustrative embodiment.

As shown in FIG. 4, the supporting stitching along the uppermost edge 14' of the upper 30 helps support the upper 30 when the uppermost edge 14' deforms as the shoe transitions to a high heel. This supporting stitching is stitching that is stronger than would normally be present on a shoe that cannot be transitioned from a flat to a high heel. Preferably, the stitching is elastic, to provide flexibility in the upper 30 when the shoe transitions to a high heel. This embodiment also includes an outersole 26' and a shank 22'. The heel 10" has an upper portion 4" that abuts the outersole 26' when screw 2" is inserted into barrel 20". In an alternative embodiment, the shoe as shown in FIG. 4 may include one or more V-shaped cutouts 32 at around the midpoint or some other location along the sides of the shoe extending from the uppermost edge 14' toward the shank 22' with the point of the V extending downward towards the shank 22'. This V-shaped cutout may be filled with a piece of elastic or some other flexible material that can be sewn or welded to the upper 30 to provide for additional flex when the shoe is worn as a high heel. FIG. 4 shows a V-shaped cutout 32 on only one side of the upper 30, but it can be included in both sides of the upper.

Figure 3:
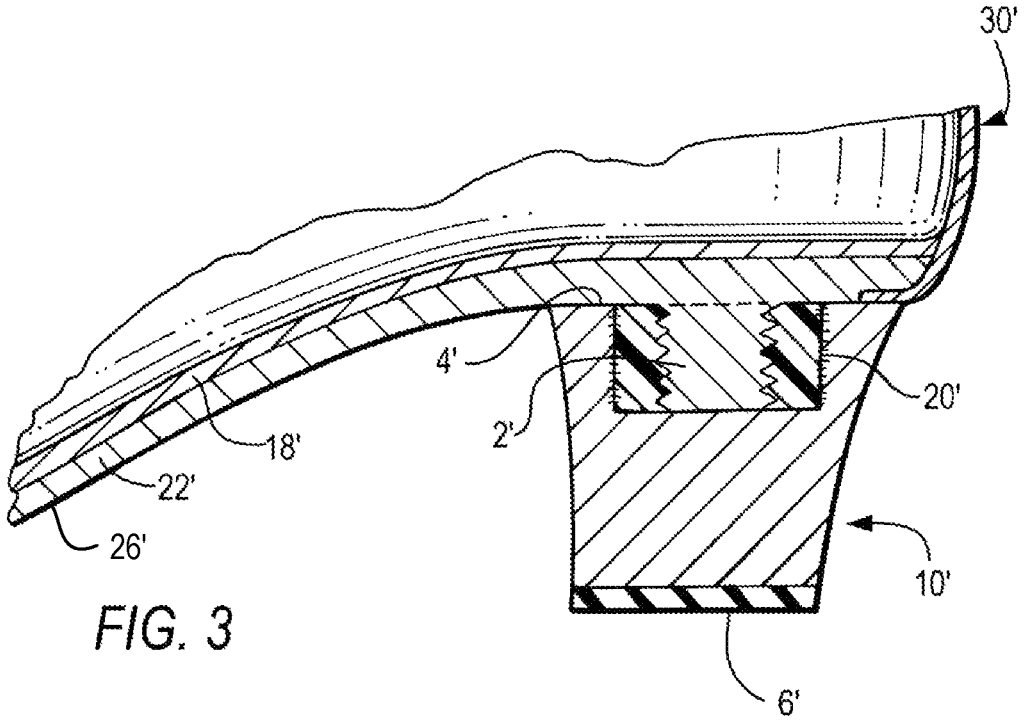
FIG. 3 is a partial cross-section of a shoe with heel attached, showing the screw and barrel in place, according to an illustrative embodiment.

In alternative embodiments, as illustrated in FIG. 3, the screw 2' protrudes from the upper 30' and the heel 10' comprises a threaded barrel 20' to which the screw 2' can be inserted into in order to secure the heel 10' to the upper 30'. Similarly, a heel 10' is also provided, where the heel 10' comprises a top portion 4' designed to attach to the upper 30', and a bottom portion 6' designed to contact the ground when the shoe is worn with the heel 10'. The heel 10' comprises a threaded barrel 20' to which a screw 2' can be inserted in order to secure the heel 10' to the upper 30'. Aside from the barrel 20', the heel 10' need not comprise any additional components at the top 4' of the heel 10' to attach to the upper 30'. Other than the switching of the screw from the heel to the upper, and the barrel from the upper to the heel, these alternative embodiments can still be utilized with any type of shoe and heel. Additionally, these alternative embodiments are envisioned to optionally comprise a midsole 18', a shank 22', an outersole 26' and/or supporting stitching as described above. The shank 22' in these embodiments may be extended to support the screw, as illustrated in FIG. 3

REFERENCES

U.S. Pat. No. 980,987.
U.S. Pat. No. 1,516,355.
U.S. Pat. No. 1,743,543.
U.S. Pat. No. 2,707,341.
U.S. Pat. No. 3,078,599.
U.S. Pat. No. 3,193,949.
U.S. Pat. No. 3,782,010.
U.S. Pat. No. 4,219,946.
U.S. Pat. No. 4,349,970.
U.S. Pat. No. 4,443,956.
U.S. Pat. No. 5,025,574.
U.S. Pat. No. 5,079,857.
U.S. Pat. No. 5,581,910.
U.S. Pat. No. 5,953,836.
U.S. Pat. No. 6,631,570.
U.S. Patent Application Publication No. 2008/0235991 A1.
U.S. Design Pat. No. D378,548.
PCT Publication No. WO 2005/000062 A1.

In view of the above, it will be seen that the several advantages of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

What is claimed is:

1. A shoe comprising: a plate containing a barrel therein, wherein the barrel is internally threaded, wherein the barrel includes a lower open end portion and an upper closed end portion; a heel having a top portion; a shaft extending from the heel, wherein the top portion extends around the shaft, wherein the shaft is externally threaded, wherein the heel is removably coupled to the plate based on the shaft fastening to the barrel from the lower open end portion to the upper closed end portion as the top portion faces the barrel and the plate and as the barrel faces the top portion; an arch that extends from the plate in a direction away from the barrel, wherein the arch and the plate form a single continuous piece formed from a same material.

2. The shoe of claim 1, wherein the plate is rigid.

3. The shoe of claim 1, wherein the plate is flexible.

4. The shoe of claim 1, wherein the plate and the barrel form a single continuous piece formed from a same material.

5. The shoe of claim 1, wherein the top portion faces the plate other than the barrel.

6. The shoe of claim 1, wherein the shaft hosts a head within the heel such that the head is distal to the upper closed end portion when the heel is removably coupled to the plate.

7. The shoe of claim 1, wherein the upper closed end portion is rigid.

8. A shoe comprising: a plate; a shaft extending from the plate, wherein the shaft is externally and helically threaded, wherein the shaft and the plate are a single monolithic piece from form a same material; and a heel containing a barrel therein, wherein the barrel is internally and helically threaded, wherein the barrel includes a lower closed end portion and an upper open end portion, wherein the heel is removably coupled to the plate based on the shaft helically fastening to the barrel from the upper open end portion to the lower closed end portion as the barrel is perpendicular to a flat surface on which the heel stands when walking and the plate extends over the heel and the barrel; an arch that extends from the plate in a direction away from the shaft, wherein the arch and the plate form a single continuous piece formed from a same material.

9. The shoe of claim 8, wherein the plate is rigid.

10. The shoe of claim 8, wherein the plate is flexible.

11. The shoe of claim 8, wherein the heel and the barrel form a single continuous piece formed from a same material.

12. The shoe of claim 8, wherein the heel includes a top portion that faces the plate when the heel is removably coupled to the plate.

13. The shoe of claim 8, wherein the lower closed end portion is rigid.

14. The shoe of claim 8, wherein the heel contacts the plate when the heel is removably coupled to the plate.

15. A method comprising receiving a shoe and a heel wherein at least one of: the shoe comprises a plate containing a barrel therein, wherein the barrel is internally threaded, wherein the barrel includes a lower open end portion and an upper closed end portion; a heel having a top portion; a shaft extending from the heel, wherein the top portion extends around the shaft, wherein the shaft is externally threaded, wherein the heel is removably coupled to the plate based on the shaft fastening to the barrel from the lower open end portion to the upper closed end portion as the top portion faces the barrel and the plate and as the barrel faces the top portion; an arch that extends from the plate in a direction away from the barrel, wherein the arch and the plate form a single continuous piece formed from a same material, or the shoe comprises a plate; a shaft extending from the plate, wherein the shaft is externally and helically threaded, wherein the shaft and the plate are a single monolithic piece from form a same material; and a heel containing a barrel therein, wherein the barrel is internally and helically threaded, wherein the barrel includes a lower closed end portion and an upper open end portion, wherein the heel is removably coupled to the plate based on the shaft helically fastening to the barrel from the upper open end portion to the lower closed end portion as the barrel is perpendicular to a flat surface on which the heel stands when walking and the plate extends over the heel and the barrel; an arch that extends from the plate in a direction away from the shaft, wherein the arch and the plate form a single continuous piece formed from a same material.

16. The method of claim 15, wherein the shoe comprises a plate containing a barrel therein, wherein the barrel is internally threaded, wherein the barrel includes a lower open end portion and an upper closed end portion; the heel having a top portion; a shaft extending from the heel, wherein the top portion extends around the shaft, wherein the shaft is externally threaded, wherein the heel is removably coupled to the plate based on the shaft fastening to the barrel from the lower open end portion to the upper closed end portion as the top portion faces the barrel and the plate and as the barrel faces the top portion.

17. The method of claim 15, wherein the shoe comprises a plate; a shaft extending from the plate, wherein the shaft is externally and helically threaded, wherein the shaft and the plate are a single monolithic piece formed from a same material; and the heel containing a barrel therein, wherein the barrel is internally and helically threaded, wherein the barrel includes a lower closed end portion and an upper open end portion, wherein the heel is removably coupled to the plate based on the shaft helically fastening to the barrel from the upper open end portion to the lower closed end portion as the barrel is perpendicular to a flat surface on which the heel stands when walking and the plate extends over the heel and the barrel.

* * * * *